US008401720B2

(12) United States Patent
Daum et al.

(10) Patent No.: US 8,401,720 B2
(45) Date of Patent: Mar. 19, 2013

(54) SYSTEM, METHOD, AND COMPUTER SOFTWARE CODE FOR DETECTING A PHYSICAL DEFECT ALONG A MISSION ROUTE

(75) Inventors: Wolfgang Daum, Erie, PA (US); Ajith Kuttannair Kumar, Erie, PA (US); Glenn Robert Shaffer, Erie, PA (US); Christopher McNally, Girard, PA (US)

(73) Assignee: General Electric Company, Schenectady, NY (US)

( * ) Notice: Subject to any disclaimer, the term of this patent is extended or adjusted under 35 U.S.C. 154(b) by 863 days.

(21) Appl. No.: 12/484,278

(22) Filed: Jun. 15, 2009

(65) Prior Publication Data

US 2009/0254239 A1 Oct. 8, 2009

Related U.S. Application Data

(63) Continuation-in-part of application No. 11/765,443, filed on Jun. 19, 2007, which is a continuation-in-part of application No. 11/669,364, filed on Jan. 31, 2007, which is a continuation-in-part of application No. 11/385,354, filed on Mar. 20, 2006.

(Continued)

(51) Int. Cl.
*G06F 7/00* (2006.01)

(52) U.S. Cl. ..... 701/20; 701/19; 701/69; 701/70; 701/80; 701/82; 702/35; 702/36; 246/182 R; 246/182 C

(58) Field of Classification Search ..... 701/19, 701/20, 69, 70, 80, 82, 91, 517; 702/35, 702/36; 246/182 R, 182 C See application file for complete search history.

(56) References Cited

U.S. PATENT DOCUMENTS

| | | | |
|---|---|---|---|
| 2,104,652 | A | 1/1938 | Inman |
| 2,601,634 | A | 6/1952 | Rivette |
| 2,927,711 | A | 3/1960 | Naggiar |
| 3,519,805 | A | 7/1970 | Thorne-Booth |
| 3,650,216 | A | 3/1972 | Harwick et al. |
| 3,655,962 | A | 4/1972 | Koch |

(Continued)

FOREIGN PATENT DOCUMENTS

| | | |
|---|---|---|
| CH | 642 418 | 4/1984 |
| DE | 197 26 542 | 11/1998 |

(Continued)

OTHER PUBLICATIONS

Razouqi et al. RYNSORD: A Novel, Decentralized Algorithm for Railway Networks with 'Soft Reservation', VTC, 1998, pp. 1585-2589, V3, New York, NY.

(Continued)

*Primary Examiner* — Thomas Black
*Assistant Examiner* — Peter D Nolan
(74) *Attorney, Agent, or Firm* — GE Global Patent Operation; John A. Kramer

(57) ABSTRACT

A route defect detection system for a powered system, the route defect detection system including a control system connected to the powered system for application of tractive effort, and a processor to determine an unplanned change in the application of tractive effort and/or otherwise associated with the tractive effort of the powered system. Based on the unplanned change, the processor determines a type of defect encountered along a mission route. A method and computer software code stored on a computer readable media and executable with a processor are also disclosed for a powered system to detect a defect along a mission route.

34 Claims, 2 Drawing Sheets

Related U.S. Application Data

(60) Provisional application No. 60/894,039, filed on Mar. 9, 2007, provisional application No. 60/939,852, filed on May 24, 2007, provisional application No. 60/849,100, filed on Oct. 2, 2006, provisional application No. 60/850,885, filed on Oct. 10, 2006.

(56) References Cited

U.S. PATENT DOCUMENTS 3,781,139 A 12/1973 Lohse
3,794,833 A 2/1974 Blazek et al.
3,865,042 A 2/1975 DePaola et al.
3,886,870 A 6/1975 Pelabon
3,948,314 A 4/1976 Creswick et al.
4,005,838 A 2/1977 Grundy
4,041,283 A 8/1977 Mosier
4,042,810 A 8/1977 Mosher
4,136,432 A 1/1979 Melley, Jr.
4,181,943 A 1/1980 Mercer, Sr.
4,253,399 A 3/1981 Spigarelli
4,279,395 A 7/1981 Boggio et al.
4,344,364 A 8/1982 Nickles et al.
4,401,035 A 8/1983 Spigarelli et al.
4,548,164 A 10/1985 Ylonen et al.
4,561,057 A 12/1985 Haley, Jr. et al.
4,602,335 A 7/1986 Perlmutter
4,617,627 A 10/1986 Yasunobu et al.
4,644,705 A 2/1987 Saccomani et al.
4,663,713 A 5/1987 Cornell et al.
4,711,418 A 12/1987 Aver, Jr. et al.
4,735,385 A 4/1988 Nickles et al.
4,794,548 A 12/1988 Lynch et al.
4,827,438 A 5/1989 Nickles et al.
4,843,575 A 6/1989 Crane
4,853,883 A 8/1989 Nickles et al.
5,109,343 A 4/1992 Budway
5,181,541 A 1/1993 Bodenheimer
5,187,945 A 2/1993 Dixon
5,197,627 A 3/1993 Disabato et al.
5,239,472 A 8/1993 Long et al.
5,240,416 A 8/1993 Bennington
5,253,153 A 10/1993 Mathews et al.
5,316,174 A 5/1994 Schutz
5,363,787 A 11/1994 Konopasek et al.
5,388,034 A 2/1995 Allen et al.
5,398,894 A 3/1995 Pascoe
5,437,422 A 8/1995 Newman
5,440,489 A 8/1995 Newman
5,460,013 A 10/1995 Thomsen
5,487,516 A 1/1996 Murata et al.
5,623,413 A 4/1997 Matheson et al.
5,642,827 A 7/1997 Madsen
5,651,330 A 7/1997 Jewett
5,676,059 A 10/1997 Alt
5,744,707 A 4/1998 Kull
5,755,349 A 5/1998 Brundle
5,758,299 A 5/1998 Sandborg et al.
5,785,392 A 7/1998 Hart
5,794,172 A 8/1998 Matheson et al.
5,803,411 A 9/1998 Ackerman et al.
5,828,979 A 10/1998 Polivka et al.
5,944,392 A * 8/1999 Tachihata et al. ..... 303/112
5,950,967 A 9/1999 Montgomery
5,956,664 A * 9/1999 Bryan ..... 702/184
5,957,571 A 9/1999 Koster et al.
5,998,915 A 12/1999 Scholz et al.
6,092,021 A 7/2000 Ehlbeck et al.
6,112,142 A 8/2000 Shockley et al.
6,123,111 A 9/2000 Nathan et al.
6,125,311 A 9/2000 Lo
6,129,025 A 10/2000 Minakami et al.
6,144,901 A 11/2000 Nickles et al.
6,198,993 B1 3/2001 Higashi et al.
6,216,957 B1 4/2001 Turunen, Jr.
6,230,668 B1 5/2001 Marsh et al.
6,243,694 B1 6/2001 Bonissone et al.
6,263,266 B1 7/2001 Hawthorne
6,269,034 B1 7/2001 Shibuya
6,270,040 B1 8/2001 Katzer
6,308,117 B1 10/2001 Ryland et al.
6,325,050 B1 12/2001 Gallagher et al.
6,332,106 B1 12/2001 Hawthorne et al.
6,363,331 B1 3/2002 Kyrtsos
6,380,639 B1 4/2002 Soucy
6,404,129 B1 6/2002 Hendricx et al.
6,434,452 B1 8/2002 Gray
6,459,964 B1 10/2002 Vu et al.
6,487,478 B1 * 11/2002 Azzaro et al. ..... 701/24
6,487,488 B1 11/2002 Peterson, Jr. et al.
6,505,103 B1 1/2003 Howell et al.
6,516,727 B2 2/2003 Kraft
6,520,124 B2 2/2003 Bohm, II
6,549,803 B1 4/2003 Raghavan et al.
6,591,758 B2 7/2003 Kumar
6,609,049 B1 8/2003 Kane et al.
6,612,245 B2 9/2003 Kumar et al.
6,612,246 B2 9/2003 Kumar
6,615,118 B2 9/2003 Kumar
6,647,328 B2 11/2003 Walker
6,676,089 B1 1/2004 Katzer
6,691,957 B2 2/2004 Hess, Jr. et al.
6,694,231 B1 2/2004 Rezk
6,698,913 B2 3/2004 Yamamoto
6,702,235 B2 3/2004 Katzer
6,728,606 B2 * 4/2004 Kumar ..... 701/19
6,732,023 B2 5/2004 Sugita et al.
6,763,291 B1 7/2004 Houpt et al.
6,789,005 B2 9/2004 Hawthorne
6,810,312 B2 10/2004 Jammu et al.
6,824,110 B2 11/2004 Kane et al.
6,845,953 B2 * 1/2005 Kane et al. ..... 246/20
6,853,888 B2 2/2005 Kane et al.
6,856,865 B2 2/2005 Hawthorne
6,863,246 B2 3/2005 Kane et al.
6,865,454 B2 3/2005 Kane et al.
6,873,888 B2 3/2005 Kumar
6,903,658 B2 6/2005 Kane et al.
6,910,792 B2 6/2005 Takada et al.
6,915,191 B2 7/2005 Kane et al.
6,922,619 B2 7/2005 Baig et al.
6,948,837 B2 9/2005 Suzuki
6,953,272 B2 10/2005 Hayakawa et al.
6,957,131 B2 10/2005 Kane et al.
6,973,947 B2 12/2005 Penaloza et al.
6,978,195 B2 12/2005 Kane et al.
6,980,894 B1 12/2005 Gordon et al.
6,996,461 B2 2/2006 Kane et al.
7,021,588 B2 4/2006 Hess, Jr. et al.
7,021,589 B2 4/2006 Hess, Jr. et al.
7,024,289 B2 4/2006 Kane et al.
7,036,774 B2 * 5/2006 Kane et al. ..... 246/167 R
7,072,747 B2 7/2006 Armbruster et al.
7,072,757 B2 7/2006 Adams et al.
7,073,753 B2 7/2006 Root et al.
7,079,926 B2 7/2006 Kane et al.
7,092,800 B2 8/2006 Kane et al.
7,092,801 B2 8/2006 Kane et al.
7,092,894 B1 8/2006 Crone
7,096,171 B2 8/2006 Hawthorne et al.
7,127,336 B2 10/2006 Houpt et al.
7,131,403 B1 11/2006 Banga et al.
7,164,975 B2 1/2007 Bidaud
7,222,083 B2 5/2007 Matheson et al.
7,302,895 B2 12/2007 Kumar et al.
7,340,328 B2 3/2008 Matheson et al.
7,343,314 B2 3/2008 Matheson et al.
7,347,168 B2 3/2008 Reckels et al.
7,349,797 B2 3/2008 Donnelly et al.
7,415,872 B2 * 8/2008 DeGeorge et al. ..... 73/146
7,497,201 B2 3/2009 Hollenbeck
7,500,436 B2 3/2009 Kumar et al.
7,509,193 B2 3/2009 Kustosch
7,522,990 B2 4/2009 Daum et al.
7,539,624 B2 5/2009 Matheson et al.

| | | | | |
|---|---|---|---|---|
| 7,558,740 | B2 | 7/2009 | Matheson et al. | |
| 7,618,011 | B2 | 11/2009 | Oleski et al. | |
| 7,667,611 | B2 | 2/2010 | Lindsey et al. | |
| 7,778,747 | B2 * | 8/2010 | Hawkins et al. | 701/22 |
| 2001/0029411 | A1 | 10/2001 | Hawthorne | |
| 2001/0047241 | A1 | 11/2001 | Khavakh et al. | |
| 2002/0059075 | A1 | 5/2002 | Schick et al. | |
| 2002/0072833 | A1 | 6/2002 | Gray | |
| 2002/0093201 | A1 | 7/2002 | Soucy | |
| 2002/0096081 | A1 | 7/2002 | Kraft | |
| 2002/0107618 | A1 | 8/2002 | Deguchi et al. | |
| 2002/0174653 | A1 | 11/2002 | Uzkan | |
| 2003/0001050 | A1 | 1/2003 | Katzer | |
| 2003/0034423 | A1 | 2/2003 | Hess, Jr. et al. | |
| 2003/0076221 | A1 | 4/2003 | Akiyama et al. | |
| 2003/0091017 | A1 | 5/2003 | Davenport et al. | |
| 2003/0104899 | A1 | 6/2003 | Keller | |
| 2003/0105561 | A1 | 6/2003 | Nickles et al. | |
| 2003/0120400 | A1 | 6/2003 | Ahmed Baig et al. | |
| 2003/0183729 | A1 | 10/2003 | Root et al. | |
| 2003/0213875 | A1 | 11/2003 | Hess, Jr. et al. | |
| 2003/0222981 | A1 | 12/2003 | Kisak et al. | |
| 2003/0229446 | A1 | 12/2003 | Boscamp et al. | |
| 2003/0233959 | A1 | 12/2003 | Kumar | |
| 2004/0010432 | A1 | 1/2004 | Matheson et al. | |
| 2004/0034556 | A1 | 2/2004 | Matheson et al. | |
| 2004/0068359 | A1 | 4/2004 | Neiss et al. | |
| 2004/0093245 | A1 | 5/2004 | Matheson et al. | |
| 2004/0098142 | A1 | 5/2004 | Warren et al. | |
| 2004/0104312 | A1 | 6/2004 | Hess, Jr. et al. | |
| 2004/0107042 | A1 * | 6/2004 | Seick | 701/117 |
| 2004/0108814 | A1 | 6/2004 | Tsuda et al. | |
| 2004/0111309 | A1 | 6/2004 | Matheson et al. | |
| 2004/0122569 | A1 | 6/2004 | Bidaud | |
| 2004/0129289 | A1 | 7/2004 | Hafemann | |
| 2004/0133315 | A1 | 7/2004 | Kumar et al. | |
| 2004/0172175 | A1 | 9/2004 | Julich et al. | |
| 2004/0174121 | A1 | 9/2004 | Tsuda et al. | |
| 2004/0245410 | A1 | 12/2004 | Kisak et al. | |
| 2005/0007020 | A1 | 1/2005 | Tsuda et al. | |
| 2005/0055287 | A1 | 3/2005 | Schmidtberg et al. | |
| 2005/0065674 | A1 | 3/2005 | Houpt et al. | |
| 2005/0085961 | A1 | 4/2005 | Kane et al. | |
| 2005/0109882 | A1 | 5/2005 | Armbruster et al. | |
| 2005/0120904 | A1 | 6/2005 | Kumar et al. | |
| 2005/0121005 | A1 | 6/2005 | Edwards | |
| 2005/0171655 | A1 | 8/2005 | Flynn et al. | |
| 2005/0171657 | A1 | 8/2005 | Kumar | |
| 2005/0188745 | A1 | 9/2005 | Staphanos et al. | |
| 2005/0196737 | A1 | 9/2005 | Mann | |
| 2005/0205719 | A1 | 9/2005 | Hendrickson et al. | |
| 2005/0234757 | A1 | 10/2005 | Matheson et al. | |
| 2005/0251299 | A1 | 11/2005 | Donnelly et al. | |
| 2005/0288832 | A1 | 12/2005 | Smith et al. | |
| 2006/0041341 | A1 | 2/2006 | Kane et al. | |
| 2006/0047379 | A1 | 3/2006 | Schullian et al. | |
| 2006/0060345 | A1 | 3/2006 | Flik et al. | |
| 2006/0085103 | A1 | 4/2006 | Smith, Jr. et al. | |
| 2006/0085363 | A1 | 4/2006 | Cheng et al. | |
| 2006/0116789 | A1 | 6/2006 | Subramanian et al. | |
| 2006/0116795 | A1 | 6/2006 | Abe et al. | |
| 2006/0122737 | A1 | 6/2006 | Tani et al. | |
| 2006/0155434 | A1 | 7/2006 | Kane et al. | |
| 2006/0162973 | A1 | 7/2006 | Harris et al. | |
| 2006/0212188 | A1 | 9/2006 | Kickbusch et al. | |
| 2006/0277906 | A1 | 12/2006 | Burk et al. | |
| 2006/0282199 | A1 | 12/2006 | Daum et al. | |
| 2007/0061053 | A1 | 3/2007 | Zeitzew | |
| 2007/0112475 | A1 | 5/2007 | Koebler et al. | |
| 2007/0219680 | A1 | 9/2007 | Kumer et al. | |
| 2007/0219681 | A1 | 9/2007 | Kumar et al. | |
| 2007/0219683 | A1 | 9/2007 | Daum et al. | |
| 2007/0233364 | A1 | 10/2007 | Kumar | |
| 2007/0260369 | A1 | 11/2007 | Philp et al. | |
| 2007/0261648 | A1 | 11/2007 | Reckels et al. | |
| 2008/0004721 | A1 | 1/2008 | Huff et al. | |
| 2008/0110249 | A1 * | 5/2008 | DeGeorge et al. | 73/146 |
| 2008/0128563 | A1 | 6/2008 | Kumar et al. | |
| 2008/0147256 | A1 | 6/2008 | Liberatore | |
| 2008/0208393 | A1 | 8/2008 | Schricker | |
| 2009/0063045 | A1 | 3/2009 | Figueroa et al. | |
| 2009/0140574 | A1 | 6/2009 | Gorman et al. | |
| 2009/0177345 | A1 | 7/2009 | Severinsky et al. | |
| 2009/0254239 | A1 | 10/2009 | Daum et al. | |
| 2009/0319092 | A1 | 12/2009 | Piche | |
| 2010/0152998 | A1 | 6/2010 | Schwarzmann | |

FOREIGN PATENT DOCUMENTS

| | | |
|---|---|---|
| DE | 198 30 353 | 2/2001 |
| DE | 199 35 349 | 2/2001 |
| DE | 199 35 353 | 2/2001 |
| DE | 100 45 921 | 3/2002 |
| EP | 0 594 226 | 9/1990 |
| EP | 0 428 113 | 11/1990 |
| EP | 0 445 047 | 9/1991 |
| EP | 0 485 978 | 5/1992 |
| EP | 0 554 983 | 8/1993 |
| EP | 1 136 969 | 9/2001 |
| EP | 1 136 969 | 7/2002 |
| EP | 1 297 982 | 4/2003 |
| EP | 1 466 803 | 10/2004 |
| EP | 1 253 059 | 8/2006 |
| FR | 2 129 215 | 10/1972 |
| FR | 2 558 806 | 1/1984 |
| FR | 2 767 770 | 9/1997 |
| FR | 2 767 770 | 3/1999 |
| GB | 482 625 | 12/1936 |
| JP | 60 028153 | 2/1985 |
| JP | 50-32733 | 9/1993 |
| JP | 06-108869 | 4/1994 |
| JP | 2001-065360 | 3/2001 |
| WO | WO 95/25053 | 9/1995 |
| WO | WO 99/14093 | 3/1999 |
| WO | WO 03/097424 | 11/2003 |
| WO | WO 2004/023517 | 3/2004 |
| WO | WO 2004/051699 | 6/2004 |
| WO | WO 2004/051700 | 6/2004 |
| WO | WO 2004/052755 | 6/2004 |
| WO | WO 2004/059446 | 7/2004 |
| WO | WO 2005/061300 | 7/2005 |
| WO | WO 2005/061300 | 3/2007 |
| WO | WO 2007/027130 | 3/2007 |
| WO | WO 2007/091270 | 8/2007 |

OTHER PUBLICATIONS

ISR and WO pertaining to International application No. PCT/US2009/032933 dated Nov. 3, 2009.

Chang et al. "Cycle Detection in Repair-Based Railway Scheduling System", Robotics and Automation, 1996 pp. 2517-2522, V3, New York, NY.

Grabs, Ulrike, "Modification of Electronic Interlocking El S in Service", Signal + Draht, Telzlaff Verlag GmbH, 1995, pp. 254-258, V87(7/08), Darmstadt, DE.

Cheng, Yu, "Hybrid Simulation for Resolving Resource conflicts in Train Traffic Rescheduling", Computers in Industry, 1998, pp. 233-246, V35(3), Amsterdam, NL.

ISR and WO pertaining to International application No. PCT US2006/032893 dated Aug. 24, 2006.

ISR and WO pertaining to International application No. PCT/US2007/001428 dated Jan. 18, 2007.

ISR and WO pertaining to International application No. PCT/US2007/066697 dated Apr. 16, 2007.

ISR and WO pertaining to International application No. PCT/US2007/076699 dated Aug. 24, 2007.

ISR and WO pertaining to International application No. PCT/US2007/078001 dated Sep. 10, 2007.

ISR and WO pertaining to International application No. PCT/US2007/078016 dated Sep. 10, 2007.

ISR and WO pertaining to International application No. PCT/US2007/078118 dated Sep. 11, 2007.

ISR and WO pertaining to International application No. PCT/US2007/078340 dated Sep. 13, 2007.

ISR and WO pertaining to International application No. PCT/US2008/063193 dated May 9, 2008.

ISR and WO pertaining to International application No. PCT/US2008/083526 dated Nov. 14, 2008.
ISR and WO pertaining to International application No. PCT/US2009/031740 dated Jan. 23, 2009.
ISR and WO pertaining to International application No. PCT/US2009/032933 dated Feb. 3, 2009.
ISR and WO pertaining to International application No. PCT/US2009/037293 dated Mar. 16, 2009.
ISR and WO pertaining to International application No. PCT/US2009/045004 dated May 22, 2009.
ISR pertaining to International application No. PCT/US2010/035058 dated May 17, 2010.
ISR pertaining to International application No. PCT/US2010/047251 dated Aug. 31, 2010.

* cited by examiner

SYSTEM, METHOD, AND COMPUTER SOFTWARE CODE FOR DETECTING A PHYSICAL DEFECT ALONG A MISSION ROUTE

CROSS-REFERENCE TO RELATED APPLICATIONS

This application claims priority to and is a Continuation-In-Part of U.S. application Ser. No. 11/765,443 filed Jun. 19, 2007, which claims the benefit of U.S. Provisional Application No. 60/894,039 filed Mar. 9, 2007, and U.S. Provisional Application No. 60/939,852 filed May 24, 2007, each incorporated herein by reference in its entirety.

U.S. application Ser. No. 11/765,443 claims priority to and is a Continuation-In-Part of U.S. application Ser. No. 11/669,364 filed Jan. 31, 2007, which claims the benefit of U.S. Provisional Application No. 60/849,100 filed Oct. 2, 2006, and U.S. Provisional Application No. 60/850,885 filed Oct. 10, 2006, each incorporated herein by reference in its entirety.

U.S. application Ser. No. 11/669,364 claims priority to and is a Continuation-In-Part of U.S. application Ser. No. 11/385,354 filed Mar. 20, 2006, each incorporated herein by reference in its entirety.

BACKGROUND OF THE INVENTION

The field of invention relates to powered systems and, more specifically, to detecting a physical defect of the powered system, and/or a mission route upon which the powered system travels.

Powered systems, such as, but not limited to, off-highway vehicles, marine vessels, trains and other rail vehicle systems, agricultural vehicles, and mass cargo and mass transit transportation vehicles, usually are powered by a power unit, such as but not limited to a diesel engine. With respect to rail vehicle systems, the powered system is a locomotive, which may be part of a train that further includes a plurality of rail cars, such as freight cars. Usually more than one locomotive is provided as part of the train, where the grouping of locomotives is commonly referred to as a locomotive "consist." Locomotives are complex systems with numerous subsystems, with each subsystem being interdependent on other subsystems.

An operator is usually aboard a locomotive to ensure the proper operation of the locomotive, and when there is a locomotive consist, the operator is usually aboard a lead locomotive. As noted above, a locomotive consist is a group of locomotives that operate together for moving a train. In addition to ensuring proper operations of the locomotive or locomotive consist, the operator is also responsible for determining operating speeds of the train and forces within the train. To perform these functions, the operator generally must have extensive experience with operating the locomotive and various trains over the specified terrain. This knowledge is needed to comply with prescribed operating speeds that may vary with the train location along the track. Moreover, the operator is also responsible for ensuring that in-train forces remain within acceptable limits.

However, even with knowledge to assure safe operation of a train, the operator cannot usually operate the train to immediately detect a defect experienced by the train as it traverses a route. Typically such defects are detected by using accelerometers that are mounted on at least one axle of the train and/or within a cab of at least one locomotive that is part of the train, or at least one force gauge measurement device. A force gauge measurement instrument is used to measure the force during a "push or pull" experienced during operation of the train. More specifically, the force gauge measurement device can measure forces at couplers between the railcars and/or locomotives based on whether at least one of the locomotives is motoring where it is either pushing the railcars and/or non-motoring locomotives and/or is pulling railcars and/or non-motoring locomotives. An accelerometer is a device for measuring acceleration and gravity induced reaction forces. Single-axis and multi-axis models are available to detect magnitude and direction of the acceleration as a vector quantity. Accelerometers can be used to sense inclination, vibration, and shock.

Force gauge measurement instruments and accelerometers are mechanical devices which may malfunction due to weathering and/or normal wear and tear. Depending on when one of these devices may fail, the train operator may not have information provided by these devices available during a mission. Therefore, train owners and operators would benefit from having another approach to detect train defects while the train is performing a mission.

BRIEF DESCRIPTION OF THE INVENTION

Embodiments of the present invention relate to a system, method, and a computer software code for detecting a defect along a mission route traveled by the powered system. The system comprises a control system connected to the powered system for application of tractive effort, and a processor to determine an unplanned change in the application of tractive effort and/or otherwise associated with the tractive effort of the powered system. Based on the unplanned change, the processor determines a type of defect encountered along a mission route.

In another embodiment, the method comprises monitoring a tractive effort of the powered system, and identifying an unplanned change in the tractive effort. A type of the unplanned change in the tractive effort identified is determined, using a processor. A type of defect along the mission route is determined based on the type of unplanned change in tractive effort identified.

In yet another embodiment, the computer software code is stored on a computer readable media and executable with a processor. The computer software code comprises a computer software module for gathering information about a tractive effort of the powered system, when executed by the processor. A computer software module for identifying an unplanned change in the tractive effort, when executed by the processor is further included. Also included is a computer software module for determining a type of defect along the mission route based on a type of unplanned change in tractive effort identified, when executed by the processor.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

Figure 1:
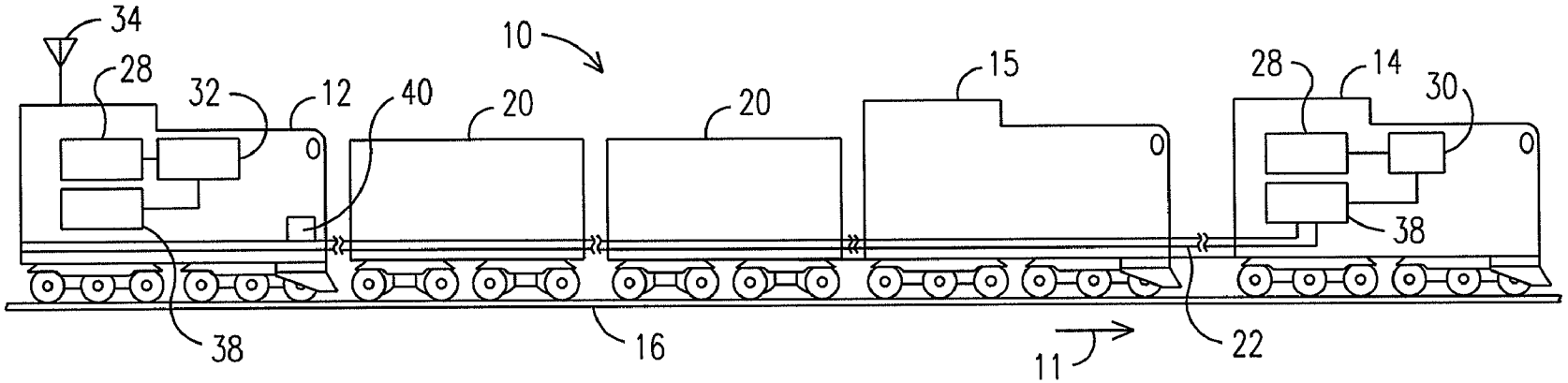
FIG. 1 illustrates a distributed power train to which the teachings of the present invention can be applied.

Reference will be made below in detail to exemplary embodiments of the invention, examples of which are illustrated in the accompanying drawings. Wherever possible, the same reference numerals used throughout the drawings refer to the same or like parts. As disclosed below, multiple versions of a same element may be disclosed. Likewise, with respect to other elements, a singular version is disclosed. Neither multiple versions disclosed nor a singular version disclosed shall be considered limiting. Specifically though multiple versions are disclosed a singular version may be utilized. Likewise, where a singular version is disclosed, multiple versions may be utilized.

Though exemplary embodiments of the present invention are described with respect to rail vehicles, or railway transportation systems, specifically trains and locomotives, exemplary embodiments of the invention are also applicable for use with other powered systems, such as but not limited to marine vessels, off-highway vehicles, agricultural vehicles, and/or transportation vehicles, each which may use at least one engine. Towards this end, when discussing a specified mission, this includes a task or requirement to be performed by the powered system. Therefore, with respect to a rail vehicle, marine vessel, agricultural vehicle, mass cargo or mass transit transportation vehicle, or off-highway vehicle applications, this may refer to the movement of a collective powered system (where more than one individual powered system is provided) from a present location to a distant location.

Though diesel powered systems are readily recognized when discussing trains or locomotives, those skilled in the art will readily recognize that embodiments of the invention may also be utilized with non-diesel powered systems, such as but not limited to natural gas powered systems, bio-diesel powered systems, electric powered systems, a combination of the above, etc. Furthermore, the individual powered system may include multiple engines, other power sources, and/or additional power sources, such as, but not limited to, battery sources, voltage sources (such as but not limited to capacitors), chemical sources, pressure based sources (such as but not limited to spring and/or hydraulic expansion), electrical current sources (such as but not limited to inductors), inertial sources (such as but not limited to flywheel devices), gravitational-based power sources, and/or thermal-based power sources. Additionally, the power source may be external, such as but not limited to, an electrically powered system, such as a locomotive or train, where power is sourced externally from overhead catenary wire, third rail, and/or magnetic levitation coils.

Exemplary embodiments of the invention solve problems in the art by providing a method, system, and computer implemented method, such as a computer software code or computer readable media, for detecting a defect on a mission route as a powered system progresses along the mission route. With respect to locomotives, exemplary embodiments of the present invention are also operable when the locomotive consist is in distributed power operations. Distributed power operations however are not only applicable to locomotives or trains. The other powered systems disclosed herein may also operate in a distributed power configuration.

In this document the term "locomotive consist" is used. As used herein, a locomotive consist may be described as having one or more locomotives in succession, connected together so as to provide motoring and/or braking capability. The locomotives are connected together where no train cars are in between the locomotives. The train can have more than one locomotive consists in its composition. Specifically, there can be a lead consist and one or more remote consists, such as midway in the line of cars and another remote consist at the end of the train. Each locomotive consist may have a first locomotive and trail locomotive(s). Though a first locomotive is usually viewed as the lead locomotive, those skilled in the art will readily recognize that the first locomotive in a multi locomotive consist may be physically located in a physically trailing position.

Though a locomotive consist is usually viewed as involving successive locomotives, those skilled in the art will readily recognize that a consist group of locomotives may also be recognized as a consist even when one or more rail cars separate the locomotives, such as when the locomotive consist is configured for distributed power operation, wherein throttle and braking commands are relayed from the lead locomotive to the remote trains by a radio link or physical cable. Towards this end, the term locomotive consist should not be considered a limiting factor when discussing multiple locomotives within the same train.

As disclosed herein, the idea of a "consist" may also be applicable when referring to other types of powered systems including, but not limited to, marine vessels, off-highway vehicles, agricultural vehicles, and/or stationary power plants, that operate together so as to provide motoring, power generation, and/or braking capability. Therefore, even though the term locomotive consist is used herein in regards to certain illustrative embodiments, this term may also apply to other powered systems. Similarly, sub-consists may exist. For example, the powered system may have more than one power generating unit. For example, a power plant may have more than one diesel electric power unit where optimization may be at the sub-consist level. Likewise, a locomotive may have more than one diesel power unit. Furthermore though the exemplary examples are disclosed with respect to a rail vehicle, such disclosures are not to be considered limiting. The exemplary embodiments are also applicable to the other powered systems disclosed herein.

Persons skilled in the art will recognize that an apparatus, such as a data processing system, including a CPU, memory, I/O, program storage, a connecting bus, and other appropriate components, could be programmed or otherwise designed to facilitate the practice of the method of the invention. Such a system would include appropriate program means for executing the method of the invention.

Also, an article of manufacture, such as a pre-recorded disk, computer readable media, or other similar computer program product, for use with a data processing system, could include a storage medium and program means recorded thereon for directing the data processing system to facilitate the practice of the method of the invention. Such apparatus and articles of manufacture also fall within the spirit and scope of the invention.

Broadly speaking, a technical effect is to detect a defect on a mission route as a powered system progresses along the mission route. To facilitate an understanding of the exemplary embodiments of the invention, it is described hereinafter with reference to specific implementations thereof. Exemplary embodiments of the invention may be described in the general context of computer-executable instructions, such as program modules, being executed by any device, such as but not limited to a computer, designed to accept data, perform prescribed mathematical and/or logical operations usually at high speed, where results of such operations may or may not be displayed. Generally, program modules include routines, programs, objects, components, data structures, etc. that perform particular tasks or implement particular abstract data types. For example, the software programs that underlie exemplary embodiments of the invention can be coded in different programming languages, for use with different devices, or platforms. In the description that follows, examples of the invention may be described in the context of a web portal that employs a web browser. It will be appreciated, however, that the principles that underlie exemplary embodiments of the invention can be implemented with other types of computer software technologies as well.

Moreover, those skilled in the art will appreciate that exemplary embodiments of the invention may be practiced with other computer system configurations, including hand-held devices, multiprocessor systems, microprocessor-based or programmable consumer electronics, minicomputers, mainframe computers, and the like. Exemplary embodiments of the invention may also be practiced in distributed computing environments where tasks are performed by remote processing devices that are linked through at least one communications network. In a distributed computing environment, program modules may be located in both local and remote computer storage media including memory storage devices.

Referring now to the drawings, embodiments of the present invention will be described. Exemplary embodiments of the invention can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the invention are discussed below.

FIG. 1 schematically illustrates a distributed power train 10 in accordance with an embodiment of the invention. The train 10, traveling in a direction indicated by an arrow 11, includes a lead unit locomotive 14 and one or more remote unit locomotives 12. The illustrated exemplary train 10 includes the remote unit 12 controlled from the lead unit 14. The distributed power train 10 further includes a plurality of railcars 20 between the lead unit 14 and the remote unit 12. The arrangement of the lead locomotive 14, the remote locomotive 12, and railcars 20 illustrated in FIG. 1 is merely exemplary, as embodiments of the invention can be applied to other locomotive/railcar arrangements. For example, there may be other remote units between the remote unit 12, the railcars 20, and the lead unit 14, such as a remote unit 15 illustrated in FIG. 1, or the train may include no railcars 20. Each railcar 20 includes an air brake system (not shown) that applies the railcar air brakes in response to a pressure drop in a brake pipe 22, and releases the air brakes responsive to a pressure rise in the brake pipe 22. The brake pipe 22 runs the length of the train for conveying the air pressure changes specified by the individual braking controller (not shown) in the lead unit 14 and the remote units 12.

The lead unit 14 includes a lead controller 30 and a radio frequency module 28, or remote communications module, for generating and issuing commands and messages from the lead unit 14 to the remote unit 12, and for receiving reply messages there from. Commands are generated at the lead controller 30 in response to operator control of the traction controller (throttle) and in response to operator control of the lead braking controller within the lead unit 14. Though communications are disclosed as being performed using a radio frequency module, other forms of communicating are also applicable, such as but not limited to wired communication, serial communication, optical, multiple data paths, etc.

The remote unit 12 includes a remote controller 32 and remote communications module 28, for processing and responding to transmissions from the lead unit 14 transmitted over the communications link (e.g., by applying tractive effort or brakes at the receiving remote unit) and for issuing reply messages (e.g., acknowledging receipt and implementation of a lead unit command) and status messages back to the lead unit 14. (The term "controller" encompasses both single or stand-alone controllers, e.g., a microcontroller or computer, and systems of interoperable controllers.) Information from a force gauge measurement instrument and/or accelerometers may be collected at the remote unit 12 and communicated to the lead unit 14. Such information may be used for a determination or measurement of tractive effort. Tractive effort may include effort produced by motoring, dynamic braking, and/or air/friction braking. Tractive effort information may be collected such as disclosed above and/or with or any other measurement device, and/or tractive effort may be determined/measured using information already available which indicates force, such as but not limited to motor current, horse power, horse power combined with speed, etc.

Each locomotive 14 and 12 further includes a dynamic brake controller 38. Application of the dynamic brakes in the lead locomotive 14 generates a signal communicated to the remote unit 12 over the communications link. Responsive thereto, the remote controller 32 controls the dynamic brake controller 38 of the remote unit 12 to activate dynamic braking. Generally, application of the dynamic brakes generates relatively uniform braking forces throughout the length of the train. A transceiver, such as but not limited to a Global Position Satellite ("GPS") transceiver, is provided.

Figure 2:
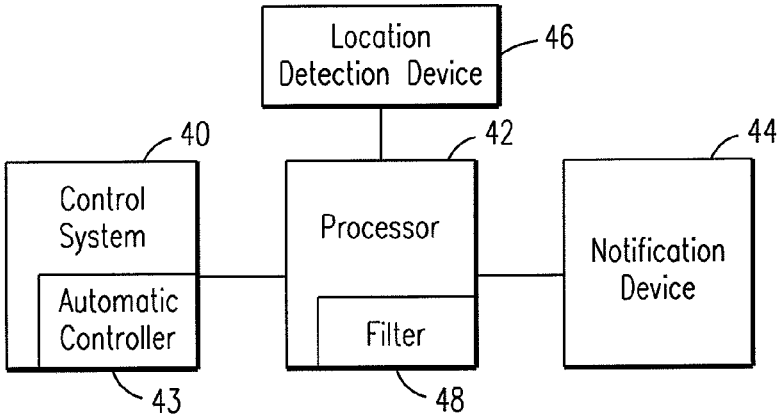
FIG. 2 discloses a block diagram depicting an exemplary embodiment of a route defect detection system for a powered system.

FIG. 2 discloses a block diagram depicting an exemplary embodiment of a route defect detection system for a powered system 10, such as the train 10 shown in FIG. 1. The system comprises a control system 40 connected to the powered system 10 for application of tractive effort. In the case of the train 10, the control system 40 may comprise, or be part of, or be connected to the lead controller 30 and/or to the other subsystems/components shown in FIG. 1. A processor 42 is included to determine an unplanned change in the application of tractive effort and/or otherwise associated with the tractive effort of the powered system 10. An unplanned change in the application of tractive effort may occur when an automatic controller 43, which is part of the control system 40, with little to no operator input, is operating the train 10. Examples of the automatic controller 43 are disclosed in trip/mission optimizer patent applications assigned to the Assignee of the present invention, such as U.S. patent application Ser. Nos. 11/765,443, 11/669,364, and 11/385,354 (see, for example, U.S. Publication No. US2007-0219680-A1 dated Sep. 20, 2007), all which are incorporated herein by reference. Information may be provided to the automatic controller 43 which will result in a deviation from a previously planned application of tractive effort. An unplanned change may be based on a plurality of events including, but not limited to, a change in tractive effort resulting from an unexpected external condition (i.e., wheel condition, track condition), and/or a change in tractive effort resulting from new information received by the controller (i.e., the change in tractive effort is unplanned not in the sense that it was uncontrolled, but rather in that it was not a part of a previous plan).

Based on the determined unplanned change, the processor 42 determines a type of defect along the mission route. To determine the unplanned changed in the application of tractive effort and/or otherwise associated with the tractive effort of the powered system, the processor 42 may use algorithms that determine trip optimizer acceleration and deceleration values versus power and train characteristics, for example. Additionally, the processor 42 is able to identify a repetitive unplanned decrease and/or increase in tractive effort for a plurality of axles of the powered system 10, application of an unplanned increase in tractive effort to meet a mission objective, a cyclic unplanned increase and/or decrease in tractive effort, and/or a short term change in a resistance associated with the tractive effort.

The system further comprises a notification device 44 to notify an operator and/or a route maintainer (entity that maintains the mission route of the powered vehicle) of the unplanned change in tractive effort and/or the type of defect determined. Also included is a location detection device 46 to identify a location along the mission route where the unplanned change is detected. A filter device 48, or function, may also be included, which is operable with the processor 42 to determine the unplanned change and/or the type of defect. The filter device 48 may comprise a low pass filter, a neural net filter, an infinite time series Taylor series expansion filter, a finite time series Taylor series expansion filter, and/or a Kalman filter. The control system 40 may adjust tractive effort and/or speed of the powered system in response to the type of defect detected. The adjustment may be reported to an operator to make the adjustment and/or the adjustment is accomplished autonomously in a closed-loop configuration. Those skilled in the art will readily recognize that a closed-loop configuration is a reference for a closed loop control system and/or process where operation is performed autonomously based on input and feedback from elements within the system. Thus, based on information provided to the processor 42, the system may command the control system.

The defect may be a result of a change to a surface condition of the route and/or a change to a part of the powered system that is in contact with a surface of the route. Therefore, depending on what is measured, the type of defect may be determined. For example, where the powered system is a train with a locomotive (having six traction motors, for example), a rail defect due to a gap between abutting rails may be identified. As the locomotive traverses over the gap, some, or all six, traction motors of the locomotive may experience wheel slip incidents since less adhesion is available at that point on the track. Those skilled in the art will recognize that when the locomotive is motoring, all six traction motors may be providing power or fewer traction motors, such as four axles, may be providing power. Using the system disclosed above, a repetitive signature which may be detected using the filter function may be identified representative of a decrease in tractive effort which is repetitive for the axles experiencing the slip, where the number of powered traction motors is taken into consideration. The wheel slip incidents may not be limited to a single locomotive. Wheel slips may be detected for locomotives in the same train. Thus, the system disclosed above may be used for when locomotives in the same train encounters wheel slip incidents. The repetitive signature will be different from the rail vehicle encountering an oil slick or debris on rail because the first few wheels will clean the rail so that the last axles/wheels would run normally.

Unplanned changes in the application of tractive effort may be determined by the system sensing or detecting electrical signals of (or associated with) traction motors in the powered system, or by detecting or measuring the mechanical motion of one or more traction-related components in the powered system, and analyzing or comparing the detected or measured values against expected or trending values. The type of defect in question may then be determined by analyzing the nature and character of the unplanned change in tractive effort, in comparison to the configuration of the vehicle and the mission route in question, for example.

In another example, a locked axle incident on a rail car may be detected. If a sudden step increase in tractive effort is required/detected and no corresponding decrease occurs, this could be identified as being associated with a locked axle on rail car. In another example, a flat spot, or worn area, on a wheel may be detected. This defect may be detected because a periodic rotation speed change in tractive effort is identified. The system disclosed above would monitor a frequency response corresponding to the rotation speed of the wheels for an abnormal frequency. If the abnormal frequency is transmitted through couplers and/or an intercommunication system between a locomotive and the rail cars, the vehicle experiencing the flat spot may also be identified.

Figure 3:
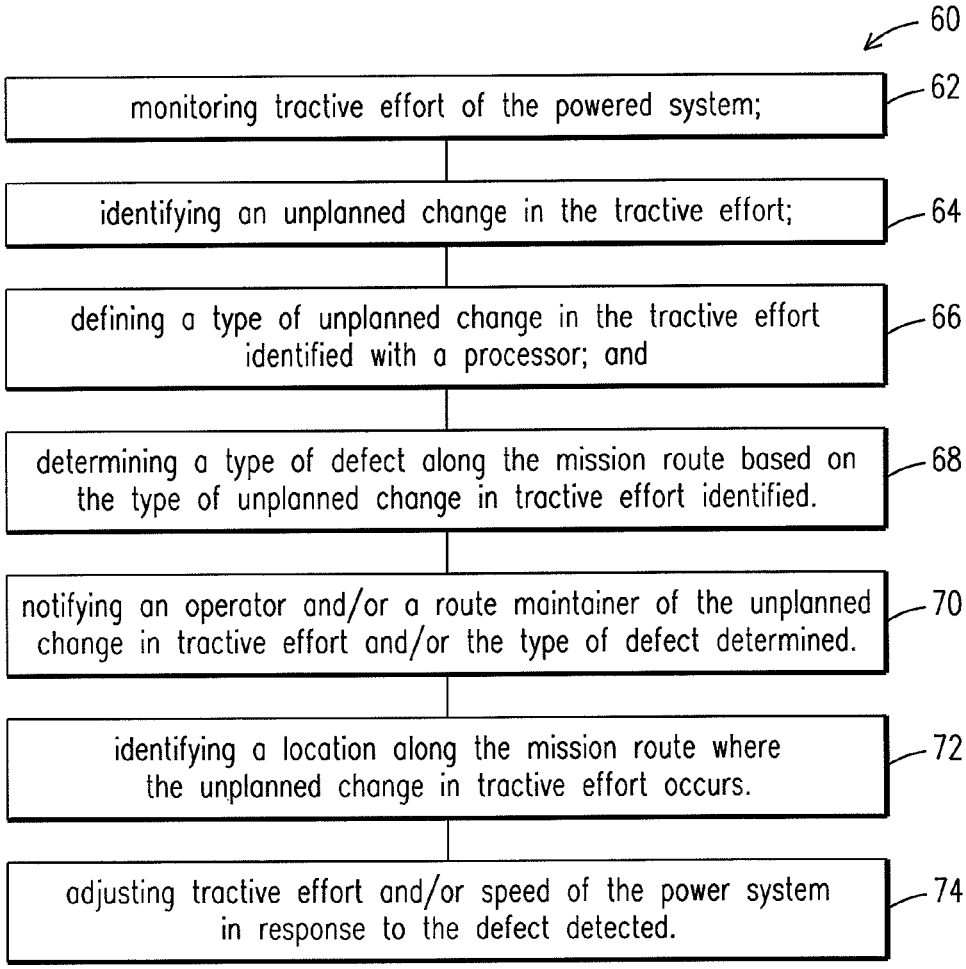
FIG. 3 depicts a flowchart illustrating an exemplary embodiment of a method for detecting a physical defect along a mission route with a powered system.

FIG. 3 depicts a flowchart 60 illustrating an exemplary embodiment of a method for detecting a physical defect along a mission route of a powered system. Tractive effort of the powered system is monitored, at 62. An unplanned change in the tractive effort is identified, at 64. Using a processor, a type of unplanned change in the tractive effort is determined, at 66. (Unless otherwise specified, "type" of unplanned change includes both a category of unplanned change and/or one or more characteristics or aspects of an unplanned change in tractive effort.) Those skilled in the art will readily recognize that the processor is not necessarily a general-purpose processor or computer. As disclosed above, the processor may be part of a system used to operate a train with little to no operator input. A type of defect along the mission route is determined based on the type of unplanned change in tractive effort identified, at 68. As disclosed above, the defect may be a result of a change to a surface condition of the route and/or a change to a part of the powered system that is in contact with a surface of the route. Determining the type of unplanned change in tractive effort may include identifying a repetitive unplanned decrease and/or increase in tractive effort for a plurality of axles of the powered system, application of an unplanned increase in tractive effort to meet a mission objective, a cyclic unplanned increase and/or decrease in tractive effort, and/or a short term change in a resistance associated with the tractive effort.

As further illustrated, an operator and/or a route maintainer is notified of the unplanned change in tractive effort and/or the type of defect determined, at 70. If the change in tractive effort is identified as being related to a condition on the rail, the location is identified, at 72. Knowing the location will allow a maintenance crew to locate the area of concern more rapidly. When the defect is detected, tractive effort and/or speed of the power system is adjusted to ensure safe operations, at 74. The adjustment may be accomplished autonomously in a closed-loop configuration. More specifically, the adjustment may be made with minimum to no operator input. In one embodiment, when the adjustment is being accomplished autonomously in a closed-loop configuration, the tractive effort is adjusted to ensure safe operations. When in an open-loop configuration, more specifically when an operator has control, speed is adjusted or a combination of speed and tractive effort are adjusted to ensure safe operations.

Those skilled in the art will readily recognize that the method disclosed in the flowchart 40 transforms information about tractive effort into an identification of when an operational condition with the powered system has changed, which may affect operations of the powered system. The transformation may be displayed to the operator and/or result in a change to the tractive effort being autonomously made.

The method shown in the flowchart 60 may be performed with a computer software code having computer software modules where the computer software code is stored on a computer media and is executed with a processor. Thus each process flow in the flowchart 60 is performed by a computer software module specific to the process contained in a specific process. For example, identifying an unplanned change in the tractive effort, when executed by the processor, at 64, is performed by a computer software module for identifying an unplanned change in the tractive effort, when executed by the processor. Those skilled in the art will also recognize that the processor 42 used to implement the method is not a generic computer.

While the invention has been described with reference to various exemplary embodiments, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A powered system comprising:

a control system configured to control application of tractive effort by a vehicle system; and a processor configured to determine an unplanned change in the application of the tractive effort, wherein the unplanned change is due to at least one of a defect in the vehicle system or an unplanned command from the control system that was not part of a previous plan, wherein the processor is configured to determine the unplanned change based on an identification of at least one of a repetitive unplanned decrease or increase in the tractive effort for a plurality of axles of the powered system;

wherein based on the unplanned change the processor is configured to determine a type of defect encountered during a mission being performed by the vehicle system.

2. The system according to claim 1, further comprising a notification device configured to notify at least one of an operator or a route maintainer of one or more of the unplanned change or the type of defect that is determined.

3. The system according to claim 1, further comprising a location detection device configured to identify a location where the unplanned change is determined.

4. The system according to claim 1, wherein the processor is configured to use a filter function to determine the unplanned change.

5. The system according to claim 4, wherein the filter function comprises at least one of a low pass filter, a neural net filter, an infinite time series Taylor series expansion filter, a finite time series Taylor series expansion filter, or a Kalman filter.

6. The system according to claim 1, wherein the at least one of the repetitive unplanned decrease or increase in the tractive effort for the plurality of axles is periodic.

7. The system according to claim 1, wherein the control system is configured to adjust at least one of the tractive effort or speed of the powered system in response to the type of defect that is determined.

8. The system according to claim 7, wherein the control system is configured to autonomously adjust the at least one of the tractive effort or the speed in a closed-loop configuration.

9. The system according to claim 1, wherein the defect is a result of a change to a part of the vehicle system that is in contact with a surface of a mission route.

10. The system according to claim 1, wherein the powered system comprises at least one of an off-highway vehicle, an agricultural vehicle, a mass cargo or mass transit transportation vehicle, a marine vessel, or a rail vehicle.

11. The system according to claim 1, wherein the unplanned command from the control system comprises a change in the tractive effort resulting from new information received by the control system.

12. A method comprising:

monitoring a tractive effort of a powered system;

identifying an unplanned change in the tractive effort;

determining a type of the unplanned change in the tractive effort that is identified, using a processor, wherein the unplanned change is due to at least one of a defect in the powered system or an unplanned command from the control system that was not part of a previous plan, wherein determining the type of the unplanned change in the tractive effort comprises identifying at least one of a repetitive unplanned decrease or increase in the tractive effort for a plurality of axles of the powered system; and determining a type of defect encountered during a mission being performed by the powered system based on the type of unplanned change in the tractive effort identified.

13. The method according to claim 12, further comprising notifying at least one of an operator or a route maintainer of one or more of the unplanned change in the tractive effort or the type of defect that is determined.

14. The method according to claim 12, further comprising identifying a location where the unplanned change in the tractive effort occurs.

15. The method according to claim 12, further comprising adjusting at least one of the tractive effort or speed of the powered system in response to the type of defect determined.

16. The method according to claim 15, wherein the adjusting is accomplished autonomously in a closed-loop configuration.

17. The method according to claim 12, wherein the defect is a result of a change to a part of the powered system that is in contact with a surface of a mission route.

18. The method according to claim 12, wherein the powered system comprises at least one of an off-highway vehicle, an agricultural vehicle, a mass cargo or mass transit transportation vehicle, a marine vessel, or a rail vehicle.

19. The method according to claim 12 , wherein the at least one of the repetitive unplanned decrease or increase in the tractive effort for the plurality of axles is periodic.

20. A tangible and non-transitory computer readable medium comprising one or more computer software modules configured to direct a processor to:

gather information about a tractive effort of a powered system;

identify an unplanned change in the tractive effort, wherein the unplanned change is due to at least one of a defect in the vehicle system or an unplanned command from a control system that was not part of a previous plan, wherein the one or more computer software modules are further configured to cause the processor to identify at least one of a repetitive unplanned decrease or increase in the tractive effort for a plurality of axles of the powered system; and determine a type of defect during a mission performed by the powered system based on a type of unplanned change in the tractive effort that is identified.

21. The computer readable medium according to claim 20, wherein the one or more computer software modules are further configured to cause the processor to notify at least one of an operator or a route maintainer of one or more of the unplanned change in the tractive effort or the type of defect that is determined.

22. The computer readable medium according to claim 20, wherein the one or more computer software modules are further configured to cause the processor to identify a location where the unplanned change in the tractive effort occurs.

23. The computer readable medium according to claim 20, wherein the one or more computer software modules are further configured to cause the processor to adjust at least one of the tractive effort or speed of the powered system in response to the type of defect that is determined.

24. The computer readable medium according to claim 23, wherein the adjusting is accomplished autonomously in a closed-loop configuration.

25. The computer readable medium according to claim 20, wherein the defect is a result of a change to a part of the powered system that is in contact with a surface of a mission route.

26. The computer readable medium according to claim 20, wherein the at least one of the repetitive unplanned decrease or increase in the tractive effort for the plurality of axles is periodic.

27. A powered system comprising:

a control system configured to control application of tractive effort by a vehicle system; and a processor configured to determine an unplanned change in the application of the tractive effort, wherein the unplanned change is determined by the processor identifying at least one of a repetitive unplanned decrease or a repetitive unplanned increase in the tractive effort for a plurality of axles of the powered system;

wherein the processor is configured to determine a type of defect encountered during a mission that is performed by the vehicle system based on the unplanned change.

28. The system according to claim 27, wherein the at least one of the repetitive unplanned decrease or the repetitive planned increase in the tractive effort of the plurality of axles is periodic.

29. The system according to claim 27, wherein the unplanned change is due to an unplanned command from the control system that was not part of a previous plan.

30. The system according to claim 27, wherein the unplanned change is due to a defect in the vehicle system.

31. The system according to claim 27, further comprising at least one of a notification device to notify an operator or a route maintainer of one or more of the unplanned change or the type of defect determined.

32. The system according to claim 27, wherein the control system adjusts at least one of the tractive effort or speed of the powered system in response to the type of defect determined.

33. The system according to claim 27, wherein the processor is configured to identify a repetitive signature that is representative of a decrease in the tractive effort that is repeated for axles experiencing a slip at a similar location during the mission.

34. The system according to claim 27, wherein the processor is configured to monitor a frequency response corresponding to a rotation speed of wheels of the powered system for an abnormal frequency.

* * * * *

UNITED STATES PATENT AND TRADEMARK OFFICE

CERTIFICATE OF CORRECTION

PATENT NO. : 8,401,720 B2
APPLICATION NO. : 12/484278
DATED : March 19, 2013
INVENTOR(S) : Daum et al.

It is certified that error appears in the above-identified patent and that said Letters Patent is hereby corrected as shown below:

In the Specification:

In Column 8, Line 65, delete “flowchart 40” and insert -- flowchart 60 --, therefor.

In the Claims:

In Column 10, Line 56, in Claim 19, delete “claim 12 ,” and insert -- claim 12, --, therefor.

Signed and Sealed this
Twentieth Day of August, 2013

Teresa Stanek Rea
*Acting Director of the United States Patent and Trademark Office*